US008873988B2

(12) United States Patent
Ogiso et al.

(10) Patent No.: US 8,873,988 B2
(45) Date of Patent: Oct. 28, 2014

(54) FIXING DEVICE CAPABLE OF MINIMIZING OVERSHOOT AND IMAGE FORMING APPARATUS WITH SAME

(75) Inventors: Toshio Ogiso, Osaka (JP); Kohichi Ono, Osaka (JP); Akinobu Nakamura, Hyogo (JP)

(73) Assignee: RICOH Company, Ltd., Tokyo (JP)

( * ) Notice: Subject to any disclaimer, the term of this patent is extended or adjusted under 35 U.S.C. 154(b) by 193 days.

(21) Appl. No.: 13/477,559

(22) Filed: May 22, 2012

(65) Prior Publication Data

US 2012/0328318 A1 Dec. 27, 2012

(30) Foreign Application Priority Data

Jun. 24, 2011 (JP) ..... 2011-140532

(51) Int. Cl.
*G03G 15/20* (2006.01)

(52) U.S. Cl.
CPC .... *G03G 15/2078* (2013.01); *G03G 2215/0132* (2013.01)
USPC ..... 399/70; 399/69

(58) Field of Classification Search
USPC ..... 399/69, 70
See application file for complete search history.

(56) References Cited

U.S. PATENT DOCUMENTS

| | | | | |
|---|---|---|---|---|
| 5,600,406 | A * | 2/1997 | Aikawa et al. | 399/70 |
| 5,761,575 | A | 6/1998 | Kimoto | |
| 6,453,131 | B1 * | 9/2002 | Sasai | 399/70 |
| 7,769,332 | B2 | 8/2010 | Yamamoto et al. | |
| 7,831,186 | B2 | 11/2010 | Obata et al. | |
| 7,953,361 | B2 | 5/2011 | Obata et al. | |
| 8,107,842 | B2 | 1/2012 | Nakamura | |
| 8,135,298 | B2 | 3/2012 | Ogiso et al. | |
| 2004/0149740 | A1 | 8/2004 | Kishi et al. | |
| 2006/0056866 | A1 | 3/2006 | Oka et al. | |
| 2006/0091130 | A1 | 5/2006 | Kishi et al. | |
| 2007/0183806 | A1 | 8/2007 | Kishi et al. | |
| 2007/0223953 | A1 | 9/2007 | Kagawa et al. | |
| 2008/0013993 | A1 | 1/2008 | Obata et al. | |
| 2008/0056783 | A1 | 3/2008 | Yamamoto et al. | |
| 2008/0069611 | A1 | 3/2008 | Obata et al. | |

(Continued)

FOREIGN PATENT DOCUMENTS

| | | | |
|---|---|---|---|
| CN | 1515130 | A | 7/2004 |
| CN | 101042563 | A | 9/2007 |

(Continued)

OTHER PUBLICATIONS

Chinese Office Action dated Jun. 23, 2014 in corresponding application No. 201210204692.2.

*Primary Examiner* — Sandra Brase
(74) *Attorney, Agent, or Firm* — Harness, Dickey & Pierce

(57) ABSTRACT

A fixing device is operable through start-up and warm-up stages and has a rotatable fixing member to fix an unfixed toner image borne on a recording medium, an opposing member to press against the fixing member and form a nip on the fixing member, a temperature detector to detect temperature of the fixing member, and a heater controlled in accordance with the temperature of the fixing member to heat the fixing member. The heater is further controlled during the warm-up stage in accordance with at least one of if the fixing member is rotating and if the detected temperature has ever arrived at a prescribed target temperature in the warm-up stage.

18 Claims, 15 Drawing Sheets

(56) References Cited

U.S. PATENT DOCUMENTS

| | | | | |
|---|---|---|---|---|
| 2009/0067866 | A1 | 3/2009 | Nakamura | |
| 2009/0110418 | A1 | 4/2009 | Ogiso et al. | |
| 2009/0175645 | A1* | 7/2009 | Seol et al. | 399/69 |
| 2009/0290893 | A1 | 11/2009 | Ogiso et al. | |
| 2010/0034548 | A1 | 2/2010 | Naitoh et al. | |
| 2010/0054785 | A1 | 3/2010 | Ogiso et al. | |
| 2011/0188874 | A1 | 8/2011 | Takahashi et al. | |
| 2012/0045241 | A1 | 2/2012 | Takahashi et al. | |

FOREIGN PATENT DOCUMENTS

| | | | |
|---|---|---|---|
| JP | 08-190292 | A | 7/1996 |
| JP | 2002-304090 | A | 10/2002 |
| JP | 2004-078181 | A | 3/2004 |
| JP | 2008-122757 | A | 5/2008 |
| JP | 2008-170646 | A | 7/2008 |

* cited by examiner

FIG. 4

| PRESENTLY DETECTED TEMPERATURE-TEMPERATURE DETECTED LAST TIME (deg) | PRESENTLY DETECTED TEMPERATURE - TARGET TEMPERATURE (deg) | | | | | | | | |
|---|---|---|---|---|---|---|---|---|---|
| | LESS THAN -18 | LESS THAN -15 | LESS THAN -12 | LESS THAN -9 | LESS THAN -6 | LESS THAN -3 | LESS THAN 0 | LESS THAN 3 | MORE THAN 4 |
| LESS THAN -3 | 100% | 100% | 100% | 100% | 100% | 100% | 100% | 0% | 0% |
| LESS THAN -2 | 100% | 100% | 100% | 100% | 100% | 100% | 100% | 0% | 0% |
| LESS THAN -1 | 100% | 100% | 100% | 100% | 100% | 100% | 100% | 0% | 0% |
| LESS THAN 0 | 100% | 100% | 100% | 100% | 100% | 100% | 100% | 0% | 0% |
| LESS THAN 1 | 100% | 100% | 100% | 100% | 100% | 100% | 100% | 0% | 0% |
| LESS THAN 2 | 100% | 100% | 100% | 100% | 100% | 100% | 100% | 0% | 0% |
| MORE THAN 3 | 100% | 100% | 100% | 100% | 100% | 100% | 100% | 0% | 0% |

FIG. 5

| PRESENTLY DETECTED TEMPERATURE−TEMPERATURE DETECTED LAST TIME (deg) | PRESENTLY DETECTED TEMPERATURE − TARGET TEMPERATURE (deg) | | | | | | | | |
|---|---|---|---|---|---|---|---|---|---|
| | LESS THAN −18 | LESS THAN −15 | LESS THAN −12 | LESS THAN −9 | LESS THAN −6 | LESS THAN −3 | LESS THAN 0 | LESS THAN 3 | MORE THAN 4 |
| LESS THAN −3 | 56% | 20% | 10% | 5% | 5% | 2% | 2% | 0% | 0% |
| LESS THAN −2 | 56% | 20% | 10% | 5% | 5% | 2% | 2% | 0% | 0% |
| LESS THAN −1 | 56% | 20% | 10% | 5% | 5% | 2% | 2% | 0% | 0% |
| LESS THAN 0 | 56% | 20% | 10% | 5% | 5% | 2% | 2% | 0% | 0% |
| LESS THAN 1 | 56% | 20% | 10% | 5% | 5% | 2% | 2% | 0% | 0% |
| LESS THAN 2 | 56% | 20% | 10% | 5% | 5% | 2% | 2% | 0% | 0% |
| MORE THAN 3 | 56% | 20% | 10% | 5% | 5% | 2% | 2% | 0% | 0% |

FIG. 15

| PRESENTLY DETECTED TEMPERATURE-TEMPERATURE DETECTED LAST TIME (deg) | PRESENTLY DETECTED TEMPERATURE - TARGET TEMPERATURE (deg) | | | | | | | | |
|---|---|---|---|---|---|---|---|---|---|
| | LESS THAN -18 | LESS THAN -15 | LESS THAN -12 | LESS THAN -9 | LESS THAN -6 | LESS THAN -3 | LESS THAN 0 | LESS THAN 3 | MORE THAN 4 |
| LESS THAN -3 | 100% | 100% | 100% | 100% | 100% | 100% | 100% | 0% | 0% |
| LESS THAN -2 | 100% | 100% | 100% | 100% | 100% | 100% | 100% | 0% | 0% |
| LESS THAN -1 | 100% | 100% | 100% | 100% | 100% | 100% | 100% | 0% | 0% |
| LESS THAN 0 | 100% | 100% | 100% | 100% | 100% | 100% | 0% | 0% | 0% |
| LESS THAN 1 | 100% | 100% | 100% | 100% | 100% | 100% | 0% | 0% | 0% |
| LESS THAN 2 | 100% | 100% | 100% | 100% | 100% | 100% | 0% | 0% | 0% |
| MORE THAN 3 | 100% | 100% | 100% | 100% | 100% | 100% | 0% | 0% | 0% |

FIXING DEVICE CAPABLE OF MINIMIZING OVERSHOOT AND IMAGE FORMING APPARATUS WITH SAME

CROSS-REFERENCE TO RELATED APPLICATION

This patent application is based on and claims priority pursuant to 35 U.S.C. §119 to Japanese Patent Application No. 2011-140532, filed on Jun. 24, 2011 in the Japanese Patent Office, the entire disclosure of which is hereby incorporated by reference herein.

BACKGROUND OF THE INVENTION

1. Field of the Invention

The present invention relates to a fixing device to fix an unfixed toner image on a recording medium and an image forming apparatus having such a fixing device.

2. Description of the Background Art

In general, a fixing device is provided in an image forming apparatus, such as a copier, a printer, a facsimile machine, a multifunctional machine having functions of these machines, etc., that employs an electrophotographic system to fix a toner image onto a recording medium, such as a paper sheet, etc. The fixing device includes, for example, a fixing roller with an internal heater and a pressing roller that presses against the fixing roller. The fixing device fixes a toner image onto the recording medium by conveying the recording medium through a nip formed by the fixing roller and the pressing roller pressing against each other.

To ensure stable fixing performance in this type of the fixing device, the temperature of the fixing roller needs to be maintained at a prescribed target temperature. Therefore, a temperature detector is generally provided to detect temperature of the surface of the fixing roller that controls the heater based on the detected temperature. As a method of controlling the heater, a so-called on/off control system is known in which the heater is turned on when the temperature detected by the temperature detector is lower than the prescribed target temperature and turned off when the detected temperature is higher than the prescribed target temperature.

However, using only on/off control the temperature of the fixing roller sometimes deviates significantly from the target temperature. Accordingly, an image forming apparatus described, for example, in Japanese Patent Application Publication No. 2008-122757 (JP-2008-122757-A) executes PID (Proportional, Integral, and Differential) control to minimize a difference (i.e., a temperature ripple) between a target temperature and a fixing roller's temperature in addition to on-off control. PID control is a method realized by combining proportional, integral, and differential calculations with a prescribed control algorithm, so that multiple parameters are optimized in accordance with the discrepancy between detected and target temperatures.

Further, to control temperature during a warm-up stage, various methods have been proposed as described, for example, in Japanese Patent Publication Nos. 2002-304090 (JP-2002-304090-A), 2004-78181 (JP-2004-78181-A), and H08-190292 (JP-H08-190292-A).

Specifically, JP-2002-304090-A employs the following relation: Standby temperature<Job start time control temperature<Job temperature, wherein the warm-up temperature represents a target temperature during a warm-up stage, the job start time control temperature represents a reference for starting a job, and the job temperature represents a target temperature during a job. Hence, an increase in the temperature of the fixing roller during the warm-up stage and conversely a decrease therein during a job runtime is minimized to provide uniform temperature at a central portion (of the fixing roller.

JP-H08-190292-A describes an approach in which a power turn-on time for supplying power to the heater is corrected in accordance with a voltage fluctuation detected during the warm-up stage to suppress the variation in temperature ripple that is generally caused by the voltage fluctuation.

Further, a system configured to rotate and heat the fixing roller during the warm-up stage is known that maintains the fixing roller at a given temperature, for example. In such a fixing device, however, a problem occurs as described below with reference to FIGS. 17 and 18.

Specifically, FIG. 17 is a diagram that shows one example of a change in the temperature of the fixing roller when the heater is controlled using the above-described on-off control method. FIG. 18 is a diagram that shows an actual temperature waveform obtained from the fixing roller of FIG. 17. As there shown, since the heater is controlled to turn on in accordance with a percentage of a ON time (hereafter simply referred to as a "ON duty") of a given control cycle, a ON duty of about 100% is used when the surface temperature at the center of the fixing roller is lower than the target temperature, whereas the ON duty is 0% when the surface temperature at the center of the fixing roller is higher than the target temperature.

Further, in such a situation, the fixing roller is stopped after it is rotated for a given time period in the warm-up stage. However, the rate of surface temperature increase at the center of the fixing roller is different when the fixing roller is rotating from when it stops rotating.

Specifically, the surface temperature at the center of the fixing roller does not increase as much when the fixing roller is stopped as when the fixing roller is rotating. As a result, the heater stays on longer than necessary when the fixing roller is rotating, and because of this the surface temperature at the center of the fixing roller overshoots the target temperature after the fixing roller enters the non-rotating state. When a paper sheet bearing toner passes through the fixing device under such an overshoot condition, the toner on the paper sheet is liquefied and cohesion thereof decreases due to its high temperature, thereby sticking to the fixing roller instead and causing a so-called high-temperature offset.

Further, even when the fixing roller is in the non-rotating state, but the target temperature has never been exceeded after the warm-up stage is entered, the overshoot again occurs frequently. This is because there is a time lag between when the heater is activated and when heat thereby generated actually increases the surface temperature of the fixing roller.

Hence, in a fixing device that heats the fixing roller while rotating it during the warm-up stage, the overshoot generally occurs after the fixing roller enters the non-rotational states from the rotational state or when a temperature of the fixing roller has never reached the target temperature after the warm-up stage is entered, and consequently a high-temperature offset more likely occurs as a problem.

However, temperature of a fixing roller is not controlled in a conventional fixing device based on rotation of the fixing roller and that of arriving of a temperature of the fixing roller at a target temperature. Yet conventionally no special countermeasures have been taken to suppress the above-described overshoot.

BRIEF SUMMARY OF THE INVENTION

Accordingly, the present invention provides a novel fixing device operable through starting up and warm-up stages and comprises a rotatable fixing member to fix an unfixed toner image borne on a recording medium, an opposing member to press against the fixing member and form a nip therebetween, a temperature detector to detect temperature of the fixing member, and a heater generally controlled to heat the fixing member in accordance with the temperature of the fixing member. The heater is further controlled during the warm-up stage in accordance with at least one of if the fixing member is rotating in the warm-up stage and if the detected temperature has ever arrived at a prescribed target temperature in the warm-up stage.

In another aspect of the present invention, the heater is activated with a ON duty of less than 100% (at no time-interval) or a ON duty of about 100% at a prescribed time interval when the fixing member is rotating and a detected temperature is lower than the prescribed target temperature in the warm-up stage.

In yet another aspect of the present invention, the heater is activated with a ON duty of less than 100% (at no time-interval) or a ON duty of about 100% at a prescribed time interval until a detected temperature reaches the prescribed target temperature when the fixing member is not rotating and the detected temperature has never reached the prescribed target temperature in the warm-up stage after the warm-up stage starts.

In yet another aspect of the present invention, the heater is activated substantially all the time when the fixing member is not rotating and a detected temperature has reached the prescribed target temperature even once after the warm-up stage starts and a currently detected temperature is lower than the target temperature in the warm-up stage.

In yet another aspect of the present invention, the heater is deactivated when the fixing member is not rotating and the detected temperature has reached the prescribed target temperature eve once after the warm-up stage starts, and a currently detected temperature is higher than a previously detected temperature and lower than the target temperature in the warm-up stage.

In yet another aspect of the present invention, the heater is activated with an ON duty of less than 100% in accordance with a difference between a detected temperature and the target temperature.

In yet another aspect of the present invention, an image forming apparatus includes a fixing device operable through starting up and warm-up stages. The fixing device comprises a rotatable fixing member to fix an unfixed toner image borne on a recording medium, an opposing member to press against the fixing member and form a nip therebetween, a temperature detector to detect temperature of the fixing member, and a heater operable in accordance with a temperature of the fixing member to heat the fixing member. The heater is further controlled during the warm-up stage in accordance with at least one of if fixing member is rotating in the warm-up stage and if the detected temperature has ever arrived at a prescribed target temperature in the warm-up stage.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein:

FIG. 4 is a chart illustrating one example of a lighting duty table used in a temperature control method according to the first embodiment of the present invention;

FIG. 5 is a chart illustrating another example of a lighting duty table used in a temperature control method according to the first embodiment of the present invention;

FIG. 15 is a chart illustrating one example of a lighting duty table used in a temperature control method according to a third embodiment of the present invention;

DETAILED DESCRIPTION OF THE INVENTION

Figure 1:
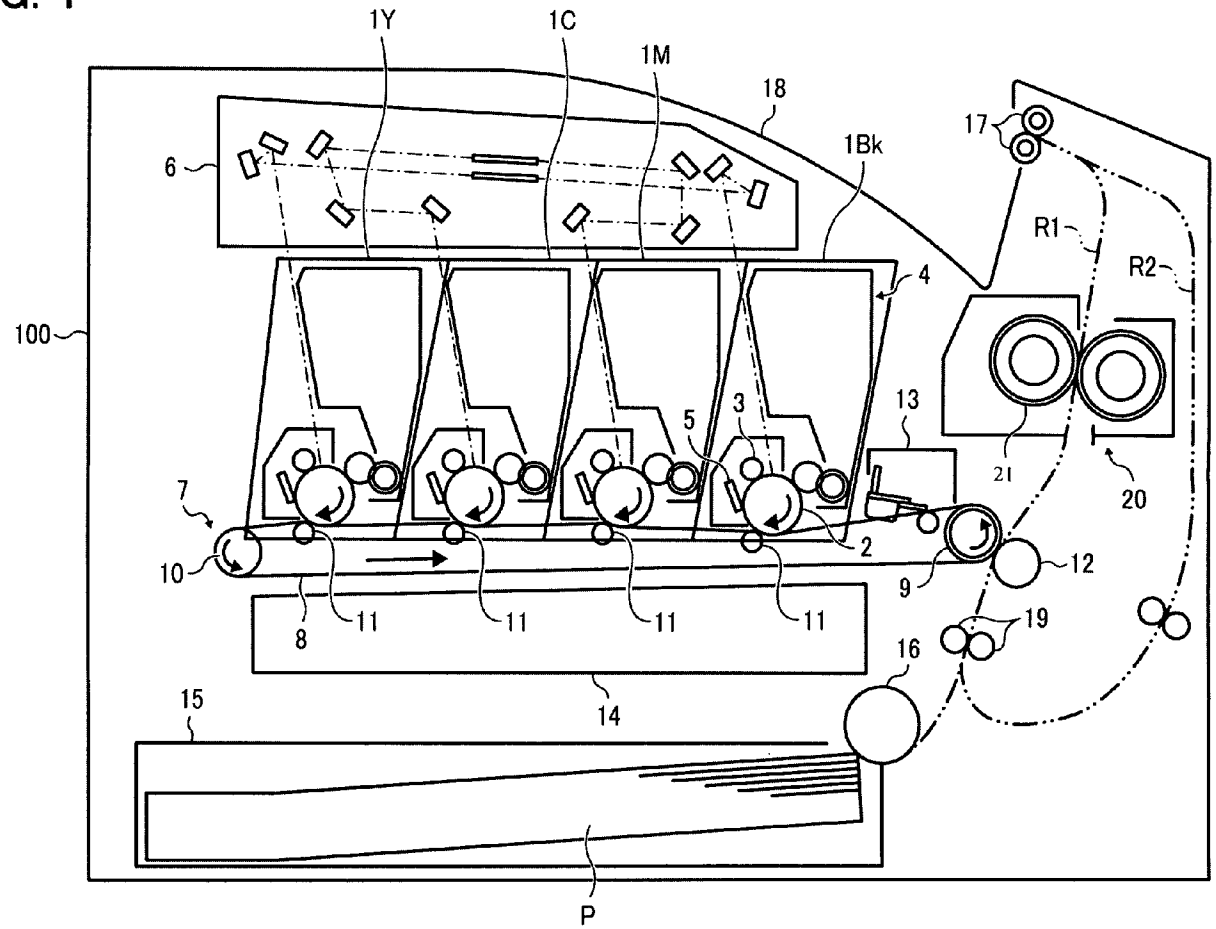
FIG. 1 is a schematic block diagram illustrating an image forming apparatus according to a first embodiment of the present invention.

Referring now to the drawings, wherein like reference numerals designate identical or corresponding parts throughout the several views thereof and in particular to FIG. 1, an operation and an overall configuration of an image forming apparatus are described according to a first embodiment of the present invention.

An image forming apparatus shown in FIG. 1 is a color laser printer. In an apparatus body 100 of the image forming apparatus, four detachably attachable process units 1Y, 1M, 1C, and 1Bk are installed as image formation units. Each of the process units 1Y, 1M, 1C, and 1Bk is similarly configured except for development agents of different colors of yellow (Y), cyan (C), magenta (M), and black (Bk) corresponding to color separation components of a color image. One-component developing agent consisting of toner or two-component developing agent consisting of toner and carrier may be used as the development agent.

In particular, each of the process units 1Y, 1C, 1M, and 1Bk includes a drum type photoconductor 2 as a latent image bearer, a charging device having a charging roller 3 or the like to charge a surface of the drum type photoconductor 2, a developer unit 4 to supply toner to the surface of the photoconductor 2, and a cleaning unit with a cleaning blade 5 or the like to clean the surface of the photoconductor 2. In FIG. 1, only the photoconductor 2, the charging roller 3, the developer unit 4, and the cleaning blade 5 included in the process unit 1Bk are typically given reference symbols and those in the other units 1Y, 1C, and 1M are omitted.

An exposure unit 6 is arranged above the process units 1Y, 1C, 1M, and 1Bk to expose the surfaces of the respective photoconductors 2. The exposure unit 6 has a light source, a polygon mirror, an f-θ lens, and a reflecting mirror or the like, and emits a laser light flux to each of the surfaces of the photoconductors 2 in accordance with image data.

Further, a transfer device 7 is arranged below each of the process units 1Y, 1C, 1M, and 1Bk. The transfer device 7 has an intermediate transfer belt 8 mainly consisting of an endless belt as a transfer member. The intermediate transfer belt 8 is stretched around a driving roller 9 and a driven roller 10 collectively serving as a supporting member, and rotates and circulates (i.e., rotation) in a direction as shown by arrow in the drawing when the driving roller 9 rotates counterclockwise in the drawing.

Four primary transfer rollers 11 are arranged at prescribed positions as primary transfer devices facing four of the photoconductors 2, respectively. Each of the primary transfer rollers 11 presses against an inner circumferential surface of the intermediate transfer belt 8 and forms a primary transfer nip at a position where each of the photoconductors 2 contacts the intermediate transfer belt 8. Further, each of the primary transfer rollers 11 is connected to a power supply, not shown, and is provided with a given direct current voltage (DC) and/or an alternating current voltage (AC) therefrom.

Further, there is provided a secondary transfer roller 12 as a secondary transfer device at a prescribed position facing the driving roller 9. The secondary transfer roller 12 presses against an outer circumferential surface of the intermediate transfer belt 8 and forms a secondary transfer nip at a position where the secondary transfer roller 12 contacts the intermediate transfer belt 8. The secondary transfer roller 12 is again connected to the power supply, not shown, as same as the primary transfer roller 11, and is provided with a prescribed direct current voltage (DC) and/or an alternating current voltage (AC) therefrom.

Further, a belt cleaning device 13 is provided on a surface of the intermediate transfer belt 8 at its right side in the drawing to clean the surface of the intermediate transfer belt 8. It is not illustrate, but a waste toner transfer hose extending from the belt cleaning unit 13 is provided to connect with an entrance of a waste toner container 14 disposed below the transfer device 7.

A sheet feed tray 15 accommodating multiple paper sheets P as recording media and a sheet feed roller 16 to convey the paper sheet P from the sheet feed tray 15 are provided at a lower section of the main body 100 of the image forming apparatus. The above paper sheet P can be a thick paper sheet, a postcard, an envelope, a plain paper sheet, a thin paper sheet, a coated paper sheet, an art paper sheet, and a tracing paper sheet or the like. As recording medium, sheet material, such as an OHP (i.e., an Over Head Projector) sheet, an OHP film, etc., is included beside the paper sheet P.

Further, a pair of sheet exit rollers 17 is arranged on the top of the main body 100 of the image forming apparatus to eject a sheet to an outside of the main body 100 of the image forming apparatus. A paper sheet exit tray 18 is also arranged there to stock ejected recording media from the pair of sheet exit rollers 17.

Further, a transportation path R1 is provided in the main body 100 of the image forming apparatus to convey the paper sheet P from the paper sheet feeding tray 15 to the sheet exit roller 17 through the secondary transfer nip. A pair of registration rollers 19 is arranged in the transportation path R1 on the upstream side of the secondary transfer roller 12 in a paper sheet transport direction as a conveyance device for conveying the paper sheet P to the secondary transfer nip. A fixing device 20 is also arranged downstream of the secondary transfer roller 12 in the paper sheet transport direction to fix an unfixed toner image transferred onto the paper sheet P thereon.

Further, a reversing path R2 is arranged in the main body 100 of the image forming apparatus as a transport path to reverse a paper sheet when duplex printing is executed on both sides thereof. The reversing path R2 is bifurcated at a position upstream of an end of the conveyance path R1 in the conveyance direction and merges with the transportation path R1 at a position upstream of the pair of registration rollers 19. When the duplex printing is executed, the above-described pair of paper sheet exit rollers 17 acts as a so-called switchback roller that conveys the paper sheet P to the reversing path R2 in a reverse direction to a sheet exit direction.

The above-described image forming apparatus operates as described below. When an image forming operation is started the photoconductor 2 of each of the process unit 1Y, 1M, 1C, and 1Bk is rotated and driven clockwise in the drawing by a driving device, not shown, and each of the surfaces of the photoconductors is uniformly charged by the charging roller 3 with a designated polarity. The laser light is emitted from the exposure unit 6 onto each of the charged surfaces of the photoconductors 2, so that an electrostatic latent image is formed on each of the surfaces of the photoconductors 2. Here, image information used in exposing each of the photoconductors 2 is monochromatic one that is obtained by resolving a desired full color image into color information pieces of yellow, cyan, magenta, and black. The electrostatic latent image thus formed on the photoconductor 2 is then visualized as a toner image (i.e., image visualization) when toner is supplied thereto from each of the developer units 4.

Subsequently, when the driving roller 9 stretching the intermediate transfer belt 8 is driven and rotated counterclockwise in the drawing, the intermediate transfer belt 8 is accordingly driven and travels in a direction shown by arrow therein. A prescribed voltage having been subjected to constant current or voltage control with an opposite polarity to a charged polarity of toner is then applied to each of the primary transfer rollers 11. Hence, a transfer electric field is formed at a primary transfer nip between each of the primary transfer rollers 11 and each of the photoconductors 2. Subsequently, each of the color toner images borne on the photoconductors 2 of the process units 1Y, 1M, 1C, and 1Bk is sequentially transferred and superimposed one by one on the intermediate transfer belt 8 in the electric transfer field formed at the above-described primary transfer nip. Thus, the intermediate transfer belt 8 ultimately bears a full-color toner image on its surface.

Further, toner not completely transferred onto the intermediate transfer belt 8 and remaining on each of the photoconductors 2 is then removed therefrom by a cleaning blade 5. Subsequently, the surface of each of the photoconductors 2 receives charge removal action from a charge removing device, not shown, and a potential thereof is initialized to prepare for the following image formation.

Further, a paper sheet P accommodated in the paper sheet feeding tray 15 disposed in the bottom of the image forming apparatus is launched into the transportation path R1 as the paper sheet feed roller 16 is driven and rotates. The paper sheet P sent to the transport path R1 is timed by the pair of registration rollers 19 and is further sent toward the secondary transferal nip formed between the driving roller 9 and the secondary transfer roller 12. Here, a transfer voltage having an opposite polarity to a charge polarity of a toner image borne on the intermediate transfer belt 8 is applied to the secondary transfer roller 12, so that an electric transfer field is formed at a secondary transfer nip. Subsequently, the toner image on the intermediate transfer belt 8 is transferred onto the paper sheet P by the electric transfer field formed at the secondary transferal nip. Otherwise, a transfer voltage having the same polarity to the charge polarity of the toner image on the intermediate transfer belt 8 can be applied to the driving roller 9 to transfer the toner image from the intermediate transfer belt 8 onto the paper sheet P.

Further, residual toner not completely transferred onto a paper sheet P and remaining on the intermediate transfer belt 8 is removed by the belt cleaning unit 13. The removed toner is then transported to and collected by a waste toner container 14 via a waste toner transfer hose, not shown.

The paper sheet P with a transferred toner image is further conveyed to the fixing device 20 and is heated and pressed by the fixing roller 21 and the pressing roller 22, respectively, so that the toner image is fused. Subsequently, the paper sheet P is transported to the pair of paper sheet exit rollers 17, and is ejected outside the main body as the pair of paper sheet exit rollers 17 rotates holding the paper sheet P therebetween.

Further, when double-sided printing is executed and the toner image on one side of the paper sheet (i.e., a front side) is fixed by the above-described fixing device 20, the paper sheet P is conveyed in the sheet exit direction by the above-described pair of exit rollers 17. At that moment, however, when a trailing end of the paper sheet P passes through a bifurcation point of the reverse path R2, the pair of paper sheet exit rollers 17 is controlled to reversely rotate. Hence, the paper sheet P is thereby switched back, and advances toward the reversing path R2. Subsequently, when it passes through the reverse path R2, the paper sheet P is guided to the transport path R1 again with its front and back sides being inverted (i.e., upside down). Hereinafter, the toner image is similarly transferred onto the backside of the paper sheet P completing the above-described various processes, and the toner image is fixed and the paper sheet P is finally discharged outside the main body.

In the above-described embodiment, a full color image is formed on the paper sheet. However, a monochrome image can be formed using one of the four process units 1Bk, 1M, 1C, and 1Y or twin or triple color images are formed using appropriate two or three process units.

Figure 2:
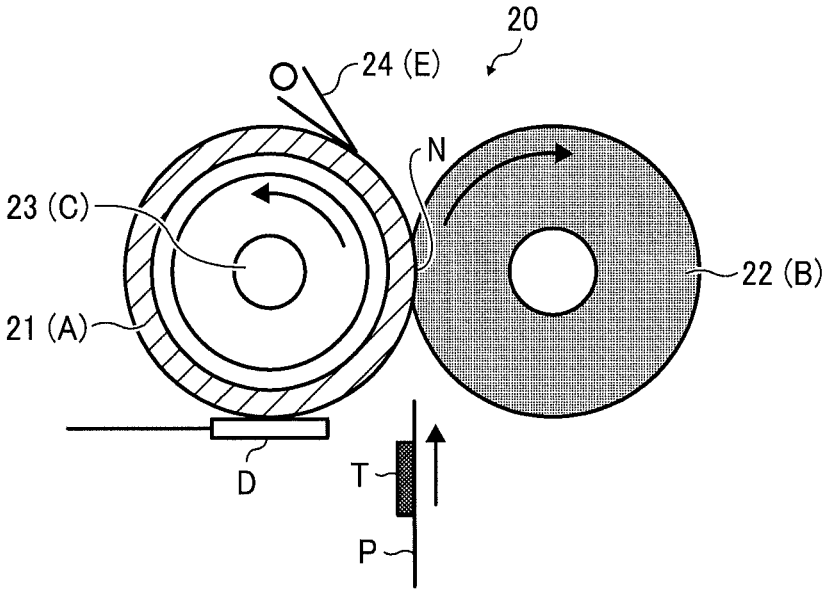
FIG. 2 is a schematic diagram illustrating a configuration of a fixing device installed in the above-described image forming apparatus.

Now, the above-described fixing device 20 is described in more detail. As shown in FIG. 2, the fixing device 20 includes a fixing member A to fix an unfixed toner image T borne on a paper sheet P, an opposing member to form a nip N between itself and the fixing member A, in which the paper sheet P bearing the unfixed toner image T passes through, and a heater C to heat the fixing member A. In this embodiment, a rotatable fixing roller 21 as a fixing rotary body constitutes the fixing member A, a rotatable pressing rollers 22 as a pressure rotary body constitutes the opposite member B, and a heater 23, such as halogen heater, etc., constitutes the heater C. The pressure roller 22 is pressed by a pressing device, not shown, and presses against the fixing roller 21, thereby forming a (i.e., fixing nip) nip at a section in which both rollers 21 and 22 presses against each other.

It should be noted that the fixing device of the present invention is not limited to the configuration described above. Specifically, a fixing belt of an endless type and an opposed belt (i.e., a pressure belt) can be used as the fixing member A and the opposing member B, respectively. As the heater C, a heat source such as an electromagnetic induction heater, etc., can be used. Further, the fixing member A and the opposing member B need not press against each other, but can simply contact each other without pressure.

The fixing device 20 has a temperature detector D to detect temperature of the fixing roller 21 and a separation pick 24 as a separator E for separating a paper sheet P from the fixing roller 21. In this embodiment, the temperature detector D detects surface temperature of the fixing roller 21 at its widthwise center in a rotary axis direction thereof. As the temperature detector D, either a non-contact type not contacting a surface of the fixing roller 21 or a contact type contacting the surface of the fixing roller 21 can be used. In the present embodiment, a contact-type detector is used as shown in FIG. 2.

The fixing device configured as described-above operates as follows. When a power switch of the main body of the image forming apparatus is turned on, an AC voltage (i.e., power supply) is provided from an AC power source to the heater 23. At the same time, the fixing roller 21 starts being driven and rotated by a drive motor, not shown, and the pressing roller 22 also starts being driven and rotated. After that, a paper sheet P is fed from the above-described paper sheet feeding tray 15, and bears an unfixed toner image thereon at the secondary transferal nip. The paper sheet P bearing the unfixed toner image (i.e., the toner image) is the conveyed to the fixing device 20, and enters the nip N formed between the fixing roller 21 and the pressing roller 22 with pressure. Then, the toner image is fused onto the surface of the paper sheet P receiving a pressing force generated between the fixing roller 21 and the pressing roller 22 and heat from the fixing roller 21. Subsequently, the paper sheet P is sent from the nip by the rotating pressing roller 22 and the fixing roller 21 and is discharged onto the paper sheet exit tray 18 by the pair of exit rollers 17.

Now, a system and method of temperature control executed in the above-described fixing device is described in detail.

Figure 3:
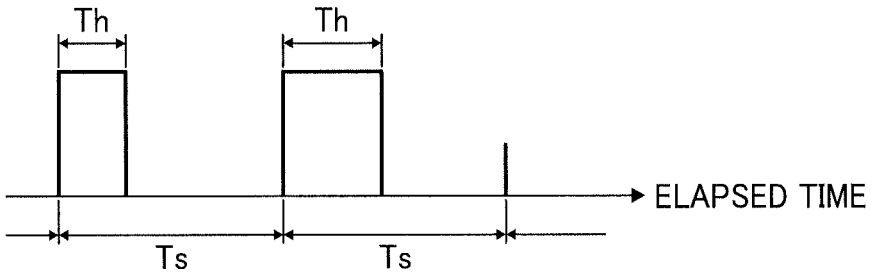
FIG. 3 is a diagram illustrating lighting control of a heater according to a first embodiment of the present invention.

First, a configuration and method of temperature control of a first embodiment of the present invention is described. Heating control for the above-described heater 23 is executed based on temperature detected by the temperature detector D. Here, a heater lighting time Th is determined per a given control cycle Ts based on temperature detected by the temperature detector D and a target temperature designated beforehand as shown in FIG. 3. A percentage of the given control of cycle Ts occupied by the lighting time Th is herein after referred to as a "lighting duty".

FIGS. 4 and 5 each illustrates one example of a heater lighting duty table used in temperature control during a warm-up stage. In each of the tables of the drawings, a lighting duty is designated based on a target temperature and a current temperature detected by the above-described temperature detector D, and a value thereof drastically varies in the tables.

Specifically, as shown in FIG. 4, when a value obtained by subtracting a target temperature from a currently detected temperature is less than 0 [deg], a lighting duty is always about 100% (i.e., heating all the time), and it is always 0% otherwise. That is, temperature control based on the table of FIG. 4 is executed such that a lighting duty is about 100% when the currently detected temperature is less than the target temperature, and the lighting duty is 0% when the currently detected temperature is higher than the target temperature to implement a so-called turn on-off control method.

By contrast, in the table of FIG. 5, a lighting duty is 0% when a currently detected temperature is higher than a target temperature as in the table of FIG. 4. However, it is different from the table of FIG. 4 that a lighting duty is below 100% when a value obtained by subtracting the target temperature from the currently detected temperature is less than 0 [deg]. Further, in the table of FIG. 5 (FIGS. 4 and 5), a lighting duty is designated based on a difference between the currently detected temperature and the target temperature, and the lighting duty increases as a value obtained by subtracting the target temperature from the currently detected temperature decreases. Here, it is noted that a detected temperature is rounded off and represented in units of degrees [deg].

In this embodiment, a warm-up stage to be controlled using the table of FIG. 4 or 5 represents two stages. One of them starts from when a starting up stage is completed after power is supplied to an apparatus of FIG. 7 until when a printing stage or a fixing stage is entered, and the other starts from when a previous printing is completed until when the printing stage is entered again. Further, the fixing roller is controlled to rotate for a prescribed time period (as extension of rotation) and then enters a non-rotating state (i.e., a static condition) when the fixing device enters the warm-up stage after the starting up stage or the previous printing stage.

Figure 6:
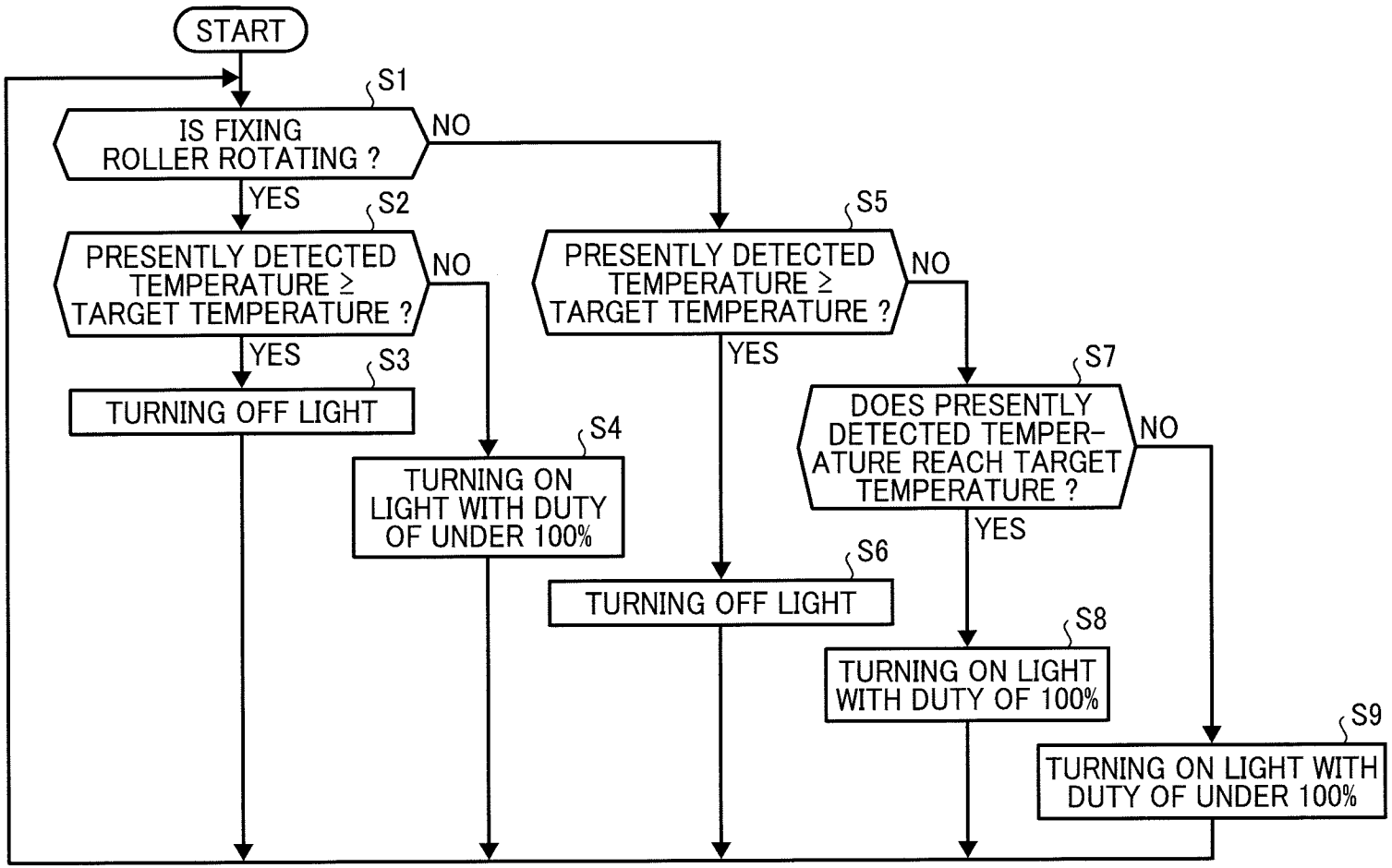
FIG. 6 is a flowchart illustrating a sequence of the temperature control method according to the first embodiment of the present invention.

Herein below, a temperature control manner implemented during the warm-up stage of the fixing device is described with reference to the flowchart of FIG. 6. To execute the temperature control during the warm-up stage, it is initially determined in step S1 whether or not the fixing roller is rotating as shown in FIG. 6. If a result of the determination is that the fixing roller is rotating, it is subsequently determined whether or not a currently detected temperature of the fixing roller is more than a target temperature in step S2. When the currently detected temperature is more than the target temperature, lighting of the heater is stopped (i.e., turned off) in step S3, because the heater does not need to generate heat any more at the moment.

By contrast, when the currently detected temperature is not more than the target temperature, the heater is turned on with a lighting duty of less than 100% with reference to the table of FIG. 5 in step S4. Here, a turn on duty (less than 100%) is chosen, which corresponds to a value calculated by the formula of "Currently detected temperature−Target temperature" as shown in FIG. 5. The similar choice goes whenever the table of FIG. 5 is referred to.

Further, when it is determined that the fixing roller is not rotating as a result of confirming in the above-described step, it is further confirmed if a currently detected temperature of the fixing roller is more than the target temperature in step S5 similar to when it is rotating. When the currently detected temperature is more than the target temperature, the heater is turned off in step S6, because the heater does not need to generate heat any more at the moment.

By contrast, when the currently detected temperature is not more than the target temperature, it is further confirmed whether or not detected temperature has ever reached the target temperature after the warm-up stage is entered in step S7. When it is confirmed that the detected temperature has reached the target temperature even once, the heater is turned on with a lighting duty of about 100% with reference to the table of FIG. 4 in step S8. By contrast, when the detected temperature has never reached the target temperature, the heater is turned on with a lighting duty of less than 100% with reference to the table of FIG. 5 in step S9. The above-described control sequence is repeated at a prescribed control cycle thereafter until the end of the warm-up stage.

Figure 7:
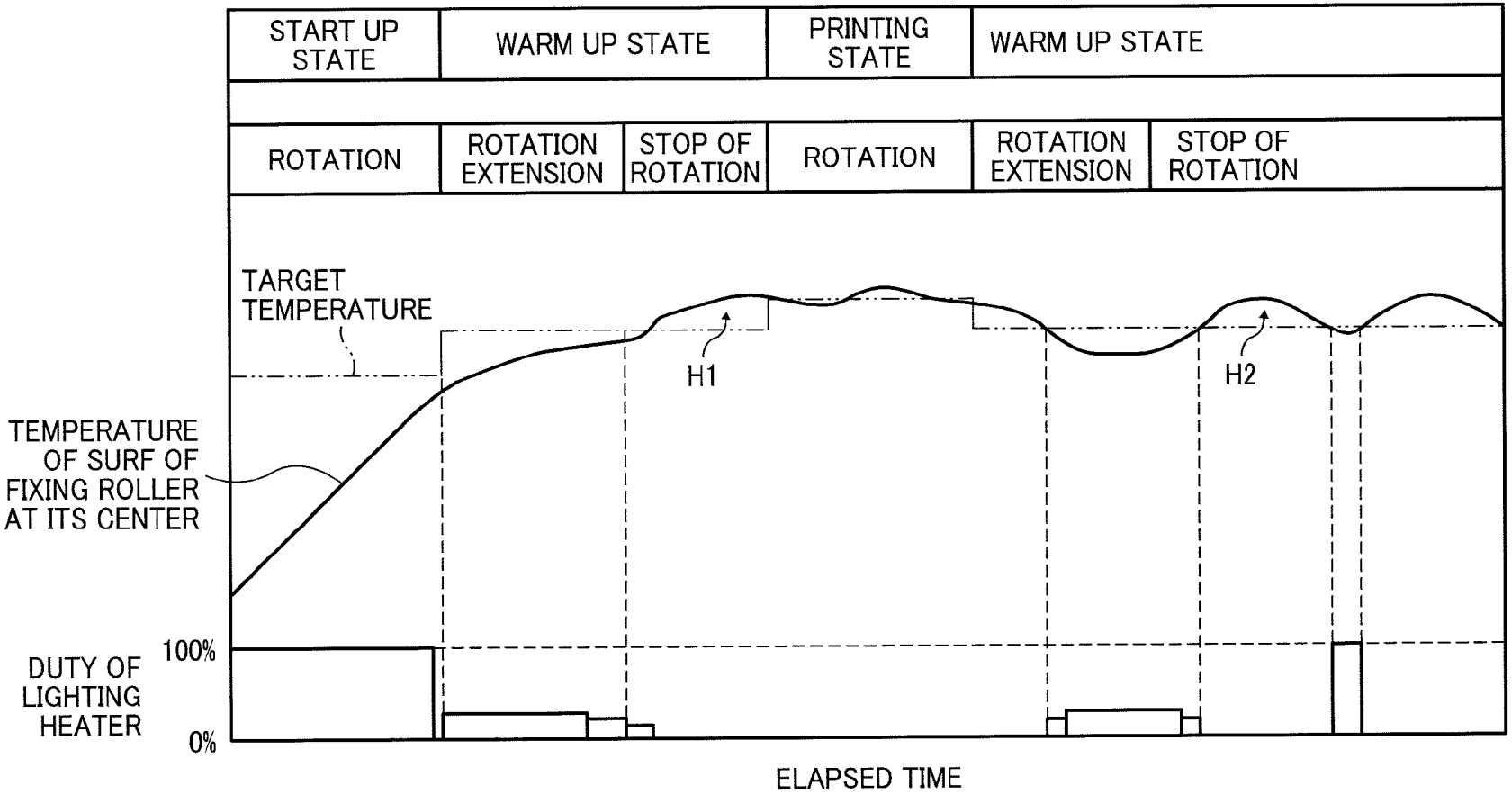
FIG. 7 is a diagram illustrating one example of a temperature change appearing in a fixing roller when the temperature control method of the above-described first embodiment is implemented.

FIG. 7 illustrates one example of a change in temperature of the fixing roller when the temperature control method according to the above-described first embodiment of the present invention is used. As noted therefrom and according to this embodiment, surface temperature at the center of the fixing roller can more effectively be controlled not to excessively rise above the target temperature as shown in FIG. 7 than a conventional temperature control method as shown in FIG. 17.

Now, function and effect of the temperature control method according to this embodiment are elaborated further in comparison with those of the conventional temperature control method.

When the conventional temperature control method is implemented, the heater is turned on with a lighting duty of about 100% during the warm-up stage. Accordingly, the surface temperature of the fixing roller overshoots the target temperature (at a section shown by a reference sign J1 in FIG. 17) when the non-rotating state is entered. By contrast, according to this embodiment, since the heater is turned on with a lighting-duty of less than 100% (until a detected temperature reaches the target temperature) when the fixing roller rotates in the warm-up stage), the overshoot conventionally caused after transition to the non-rotating state can be reduced (at a section as shown by a reference symbol H1 in FIG. 7). Specifically, by inhibiting excessive heating of the fixing roller when it rotates, i.e., when its surface temperature hardly increases, in this embodiment, the large overshoot significantly increasing the roller surface temperature in the subsequent non-rotating state can be minimized.

Figure 17:
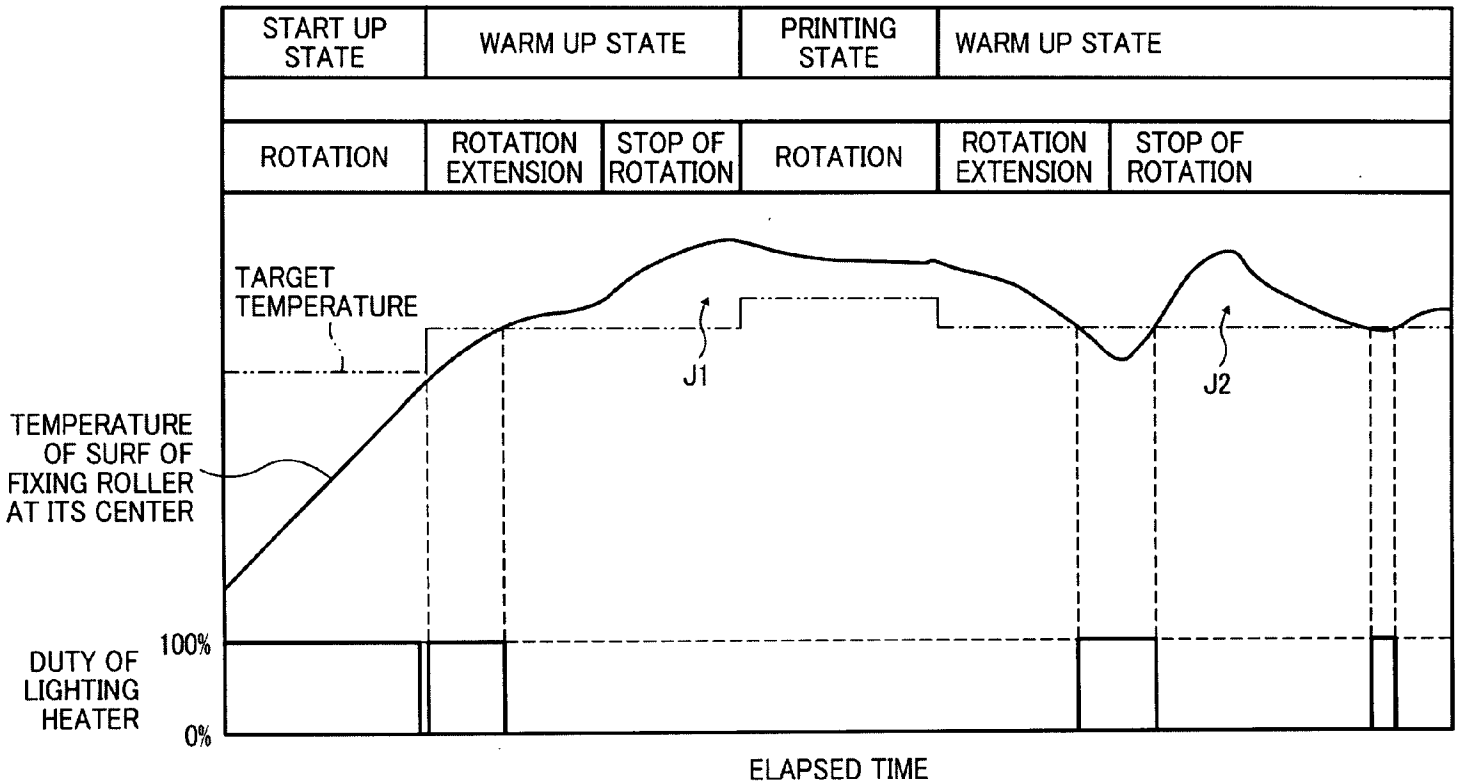
Conventional Art FIG. 17
FIG. 17 is a diagram illustrating one example of a temperature change appearing in a fixing roller when a conventional temperature control method is implemented.
Figure 18:
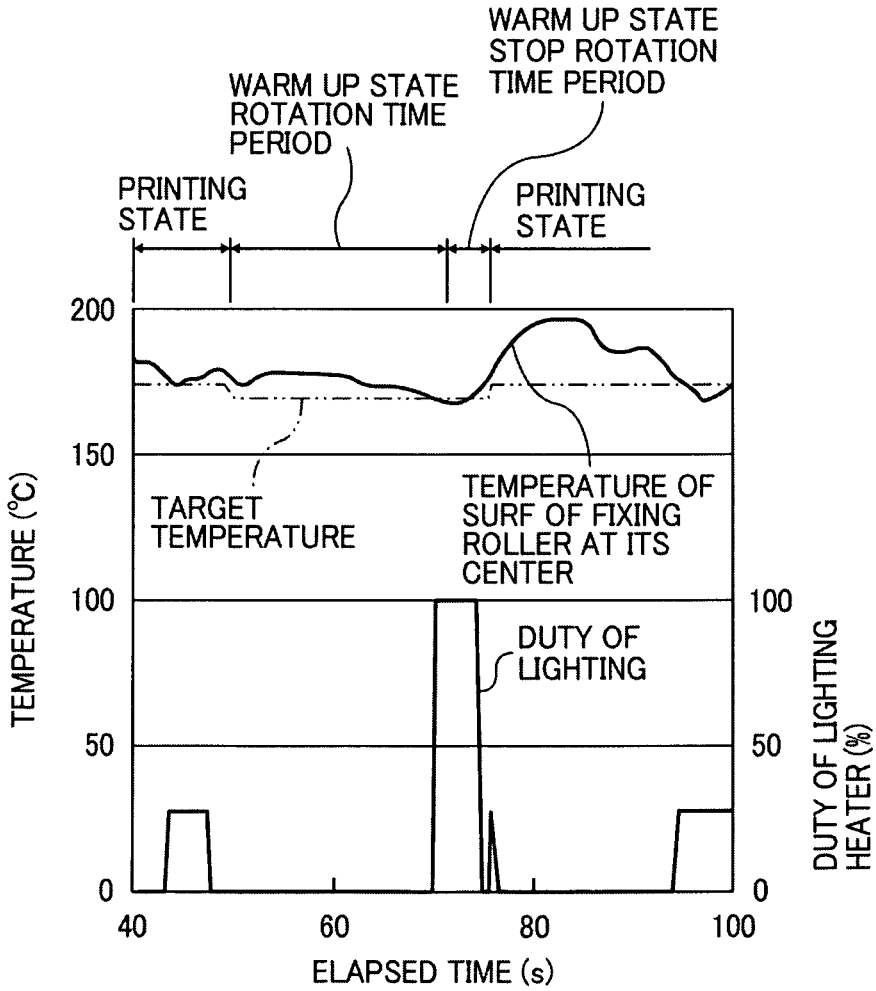
Conventional Art FIG. 18
FIG. 18 is a diagram illustrating a temperature wave actually appearing in a fixing roller when the conventional temperature control method is implemented.

Further, in the conventional temperature control method, since the heater is turned on with a lighting duty of about 100% when the fixing roller does not rotate in the warm-up stage regardless of whether a detected temperature has reached the target temperature or not, a large overshoot occurs (at a section as shown by a reference symbol J2 in FIG. 17). By contrast, in this embodiment, since the heater is turned on with a lighting duty of less than 100% (until a detected temperature reaches the target temperature) if a detected temperature has never reached the target temperature when the warm-up stage is entered and the fixing roller is not rotating at the time, the overshoot can be minimized (at a section as shown by a reference symbol H2 in FIG. 7). Specifically, by reducing heating of the fixing roller under conditions where an overshoot easily occurs quickly, i.e., in the non-rotating state, a subsequent overshoot can be minimized in this embodiment.

Figure 8:
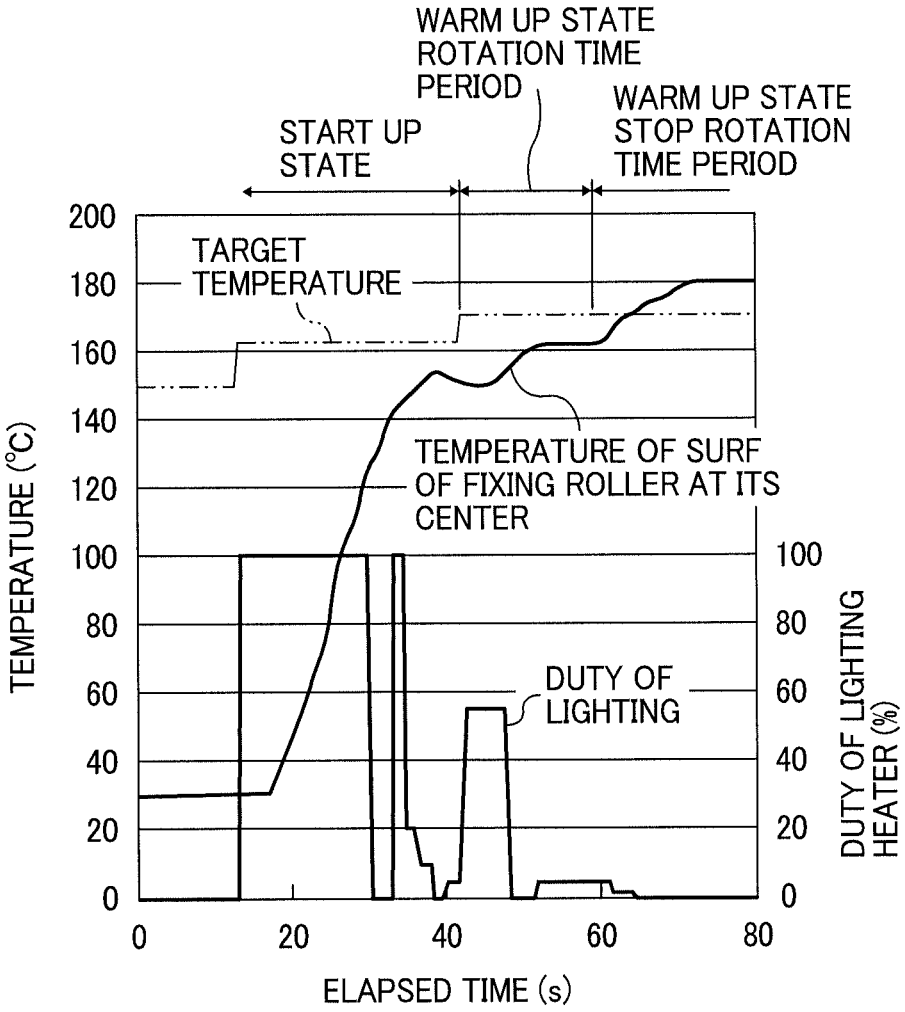
FIG. 8 is a diagram illustrating a temperature wave actually appearing in a fixing roller when the temperature control method of the above-described first embodiment is implemented.
Figure 9:
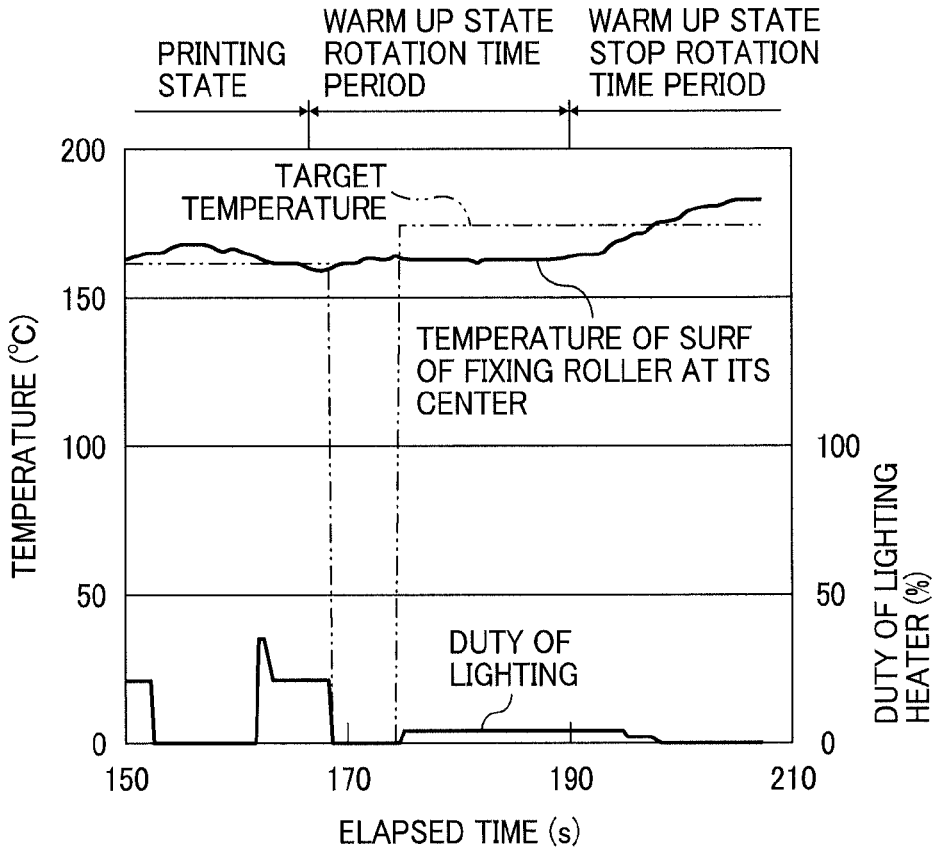
FIG. 9 is a diagram illustrating another temperature wave actually appearing in a fixing roller when the temperature control method of the above-described first embodiment is implemented.

Now, with reference to FIGS. 8 and 9, actual temperature waveforms appearing when temperature of the fixing roller is controlled using the above-described first embodiment are described. FIG. 8 shows a waveform of temperature when the startup stage changes to the warm-up stage. Whereas, FIG. 9 shows a temperature wave when a print stage changes to the warm-up stage. Hence, by using the method of this embodiment, the overshoot can be reduced both in the warm-up stage and the subsequent printing stage, and accordingly high-temperature offset may be minimized.

Figure 10:
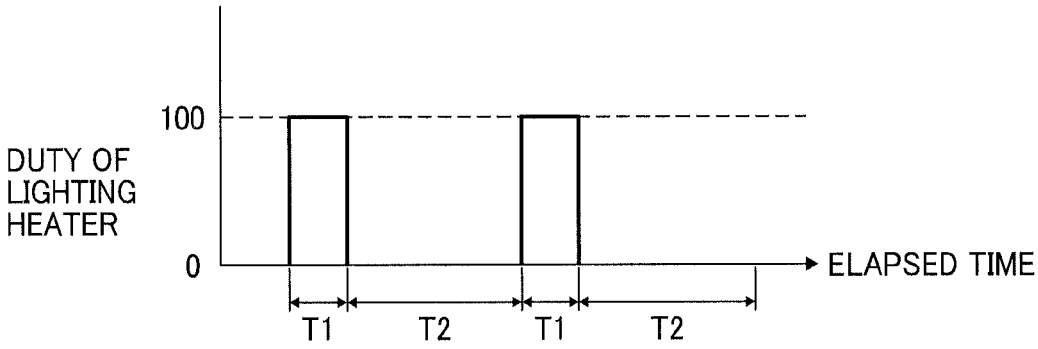
FIG. 10 is a diagram illustrating lighting control of a heater according to a second embodiment of the present invention.

Now, a system and method of controlling temperature of the fixing device of a second embodiment is described. In the first embodiment, to suppress the overshoot during the warm-up stage, a lighting duty of less than 100% is used to lighten the heater with reference to the table of FIG. 5. By contrast, in the second embodiment, instead of the above system, the heater is controlled to generate heat at a given time interval. Specifically, as shown in the FIG. 10, the heater is turned on with a lighting duty of about 100% for Time period T1, and subsequently is turned off for Time period T2 (with the same lighting duty). Then, these on and off operations are repeated. The rest of the method of control of this second embodiment is basically the same as in the above-described first embodiment.

Figure 11:
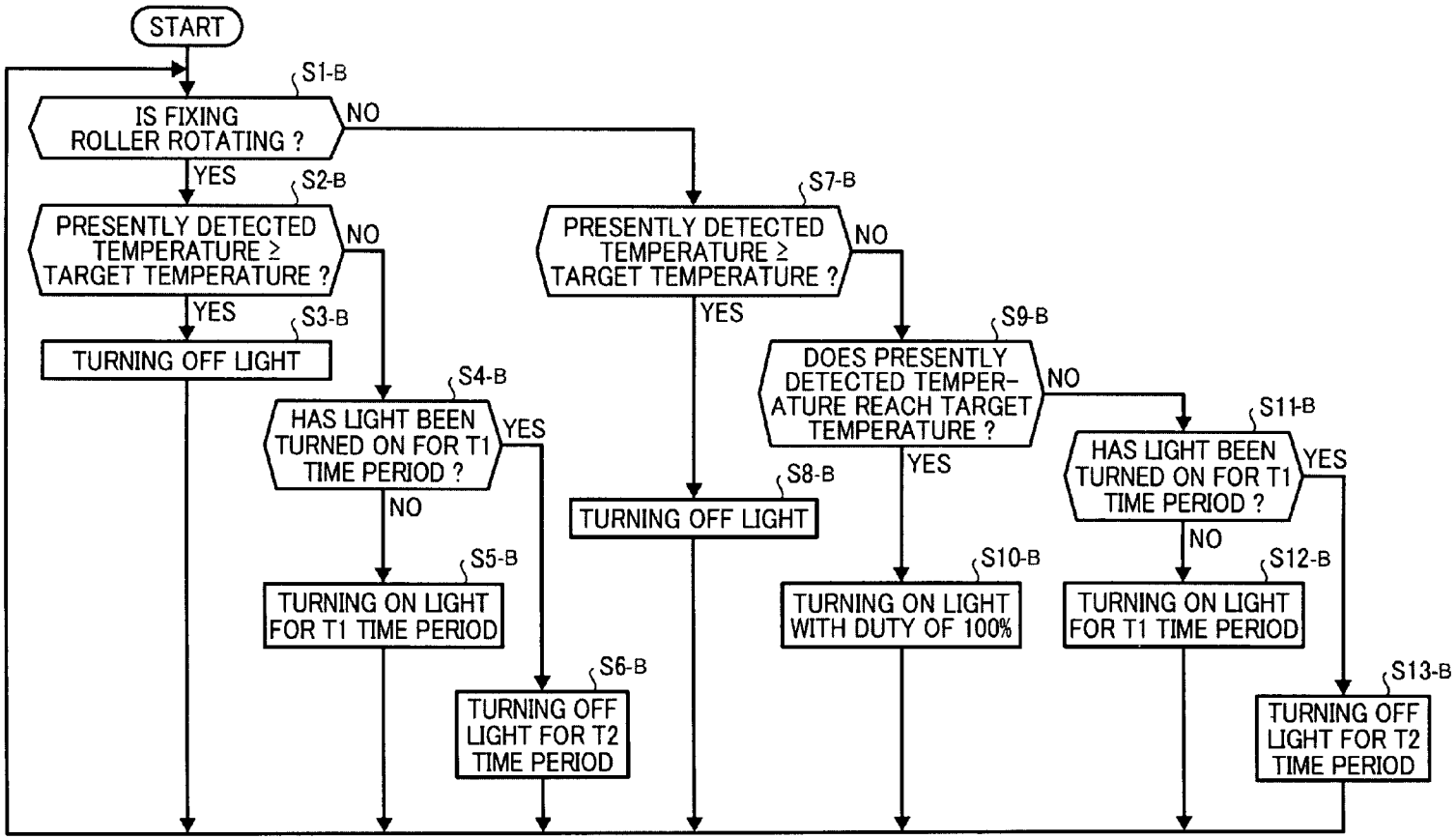
FIG. 11 is a flowchart illustrating a sequence of a temperature control method according to the second embodiment of the present invention.

Now, temperature control implemented in the second embodiment during the warm-up stage is described in greater detail with reference to a flowchart shown in FIG. 11. It is initially determined in step S1-B whether or not the fixing roller is rotating as in the first embodiment. If a result of the determination is that the fixing roller is rotating, it is subsequently determined whether a currently detected temperature of the fixing roller is more than a target temperature in step S2-B. When the currently detected temperature is more than the target temperature, lighting of the heater is stopped (i.e., turned off) in step S3-B, because the heater does not need to generate heat any more at the moment.

Whereas, when the currently detected temperature is not more than the target temperature, it is determined whether or not the heater has been turned on with a lighting duty of about 100% for a Time period T1 at an immediately preceding control cycle in step S4-B. Since the heater is not turned on for a Time period T1 in an immediately preceding control cycle when a warm-up stage is just entered, the heater is turned on with the lighting duty of about 100% for the Time period T1 for a start in step S5-B. In the subsequently control cycle, in response to the effect that it has been turned on for the Time period T1 in the previous control cycle, the heater is accordingly turned off for Time period T2 in step S6-B. Specifically, control to alternately turn on and off for T1 and Time period T2*s* shown in FIG. 10, respectively, is repeated during rotation the fixing roller until a currently detected temperature reaches and exceeds the target temperature.

Further, when it is confirmed that the fixing roller is not rotating as a result of determination in the above-described step, it is further determine whether or not a currently detected temperature of the fixing roller is more than the target temperature in step S7-B as determined during the above-described rotation state. When the currently detected temperature is more than the target temperature, the heater is turned off in step S8-B, because the heater does not need to be heated any more at the moment.

Whereas, when the currently detected temperature is not more than the target temperature, it is further determined in step S9-B whether or not a detected temperature has ever reached the target temperature even once after the warm-up stage is entered. When the detected temperature has reached the target temperature even once, the heater is turned on with a lighting duty of about 100% in step S10-B with reference to the table of FIG. 4.

When the detected temperature has never reached the target temperature even once, it is then determined whether or not the heater has been turned on with a lighting duty of about 100% for a Time period T1 in the immediately preceding control cycle in step S11-B after the fixing roller enters the non-rotational state. Since the heater is not turned on for a Time period T1 in the previous control cycle at a beginning of the non-rotational state entered, the heater is turned on with the lighting duty of about 100% for the Time period T1 for a start in step S12-B. In the following control cycle, the heater is turned off for the Time period T2 in step S13-B in response to the effect that it has been turned on for the Time period T1 in the previous control cycle. Specifically, control to alternately turn on and off for T1 and Time period T2*s* shown in FIG. 10, respectively, is repeated when the fixing roller stops rotating until a currently detected temperature reaches and exceeds the target temperature. The above-described control sequence is repeated at a prescribed control cycle thereafter until the end of the warm-up stage.

Figure 12:
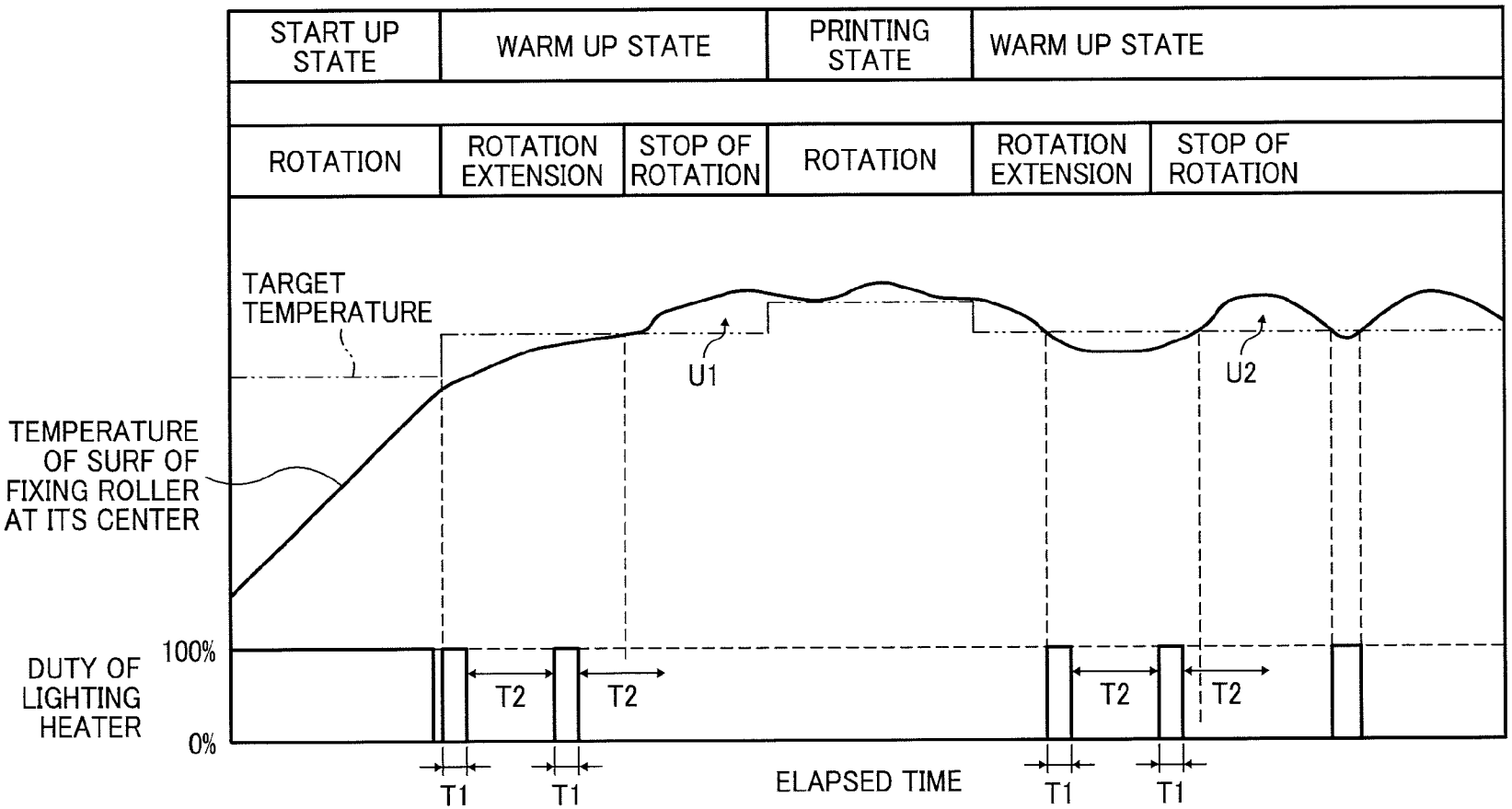
FIG. 12 is a diagram illustrating one example of a temperature change appearing in a fixing roller when the temperature control method of the above-described second embodiment is implemented.

FIG. 12 shows an example of a change in temperature of a fixing roller when a control method of the second embodiment is implemented. As shown in FIG. 12 of the second embodiment, an overshoot generally occurring when the non-rotating state of the fixing roller is entered (after the rotating state) can be minimized at a section as shown by a reference code U1 in FIG. 12, because alternating control of turning on for the Time period T1 with the lighting duty of about 100% and turning off for the Time period T2 (with the same lighting duty) is repeated (until a detected temperature reaches the target temperature). Specifically, the overshoot in which a roller surface temperature greatly increases in the subsequent non-rotating stage can be minimized also in the second embodiment by inhibiting excessive heating of the fixing roller when the heating roller rotates, i.e., when a surface temperature thereof is difficult to rise, as in the above-described first embodiment.

Further, in the second embodiment, since control to alternately turn on and off for T1 and Time period T2*s*, respectively, is repeated when the fixing roller stops rotating in the warm-up stage until a currently detected temperature exceeds the target temperature, the overshoot can be minimized at a section as shown by a reference code U2 in FIG. 12 during the non-rotating stage of the heating roller. Specifically, the subsequent overshoot can be minimized also in the second embodiment by inhibiting excessive heating of the fixing roller when the heating roller does not rotate and an overshoot likely significantly grows as in the above-described first embodiment.

Further, by executing control of alternately repeating turning on and off the heater for the Time period T1 and the Time period T2, respectively, in the second embodiment, the table of FIG. 5 used in the first embodiment can be omitted, so that the number of tables can be reduced. As a result, memory capacity of parts (e.g. a ROM for temperature control software etc.) mounted on a temperature control device can be minimized, thereby promoting cost reduction according to the second embodiment.

Figure 13:
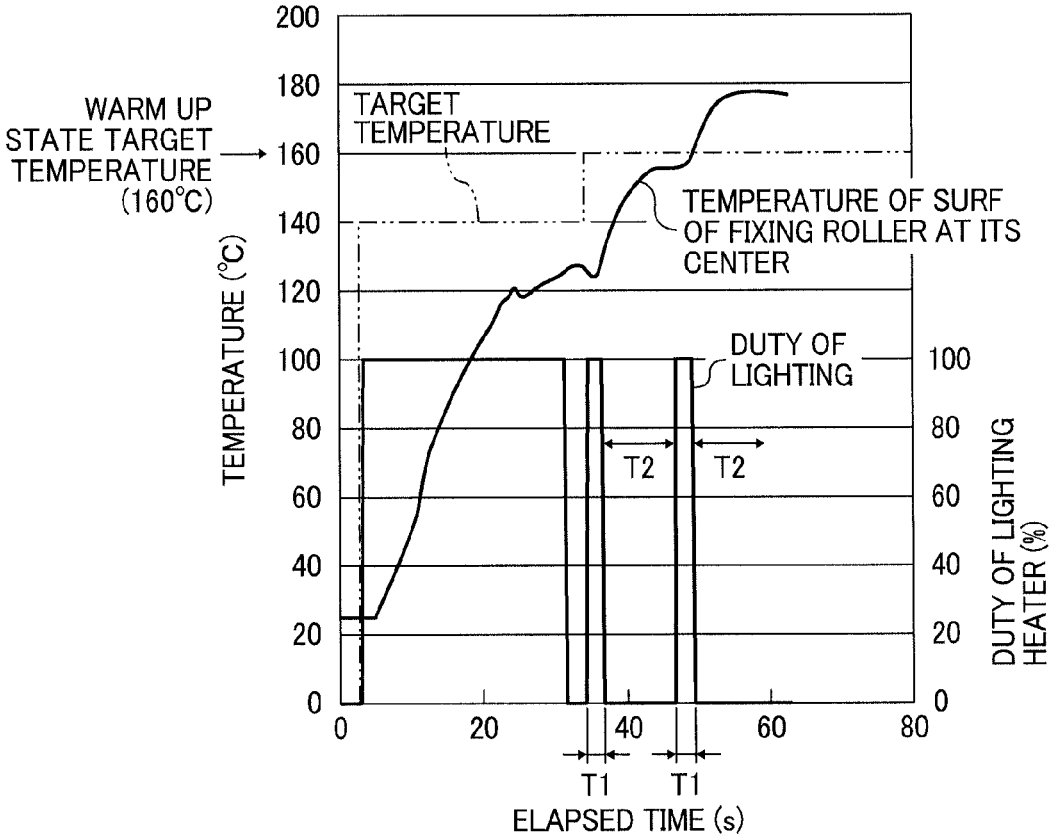
FIG. 13 is a diagram illustrating a temperature wave actually appearing in a fixing roller when the temperature control method of the above-described second embodiment is implemented.

FIG. 13 shows a waveform of an actual temperature of the fixing roller when temperature is controlled using the method of the second embodiment. Hence, by executing control of alternately repeating turning on and off the heater for the Time period T1 and the Time period T2, respectively, when the warm-up stage is entered and the fixing roller is rotating, the overshoot and high-temperature offset can be minimized during the warm-up stage and the subsequent printing stage. As shown in FIG. 13, the Time period T1 is 2.4 second and Time period T2 is 10 second, for example. However, these T1 and Time period T2*s* aren't limited to those values.

Now, a system and a method of temperature control of a fixing device according to a third embodiment of the present invention are described. In the above-described first and second embodiments, when the fixing roller is in the non-rotating state during the warm-up stage and a detected temperature has ever reached a target temperature even once, a so-called turn on-off control is executed using the table of FIG. 4.

Figure 14:
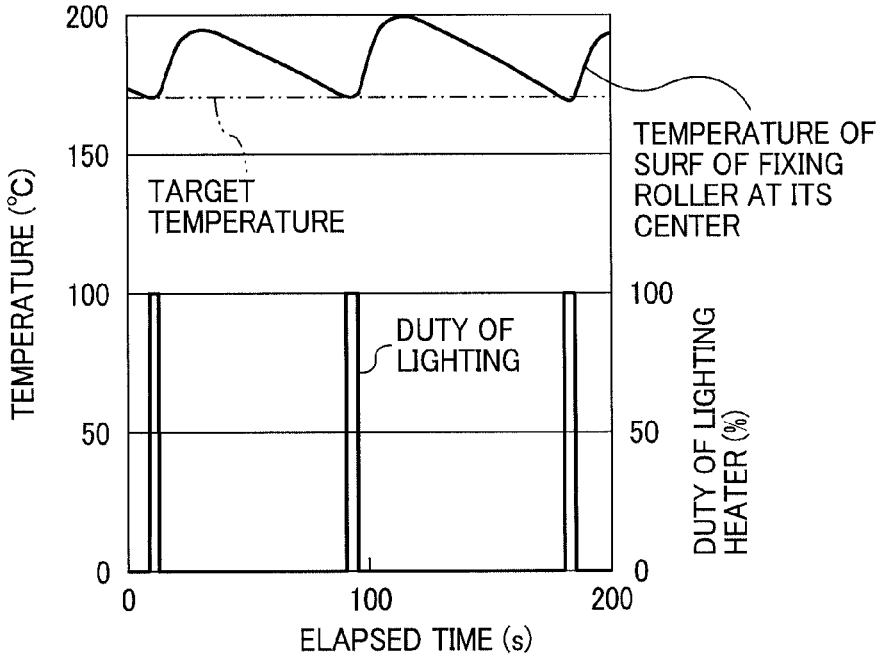
FIG. 14 is a diagram illustrating a temperature wave appearing in a fixing roller with a growing temperature ripple.

However, when the above-described turn on-off control is simply implemented in a fixing roller having a bad heat response, i.e., when a long time is needed from when a heater starts lighting to when heat thereby generated actually increases a surface temperature of the fixing roller, a temperature ripple of the fixing roller likely grows. It is realized from an experiment with a fixing roller that it takes five seconds from when it starts lighting to when a surface temperature thereof starts rising, temperature of the central surface of the fixing roller widely fluctuates between about 170° C. and about 200° C. as shown in FIG. 14.

Then, to reduce the above-described temperature ripple of the fixing roller, the third embodiment employs a table as shown in FIG. 15 instead of the table of FIG. 4, which is the only difference from the first and second embodiments. Specifically, control is similarly performed in this embodiment to that executed in the above-described first or the second embodiment except for the table.

Specifically, columns identified by a value of "less than 0" in an index of "currently detected temperature–target temperature", and values "0" to "three or more" in an index of "currently detected temperature-lastly detected temperature" in the table of FIG. 4 all have a value of 0% instead of the value of about 100% as different from the table of FIG. 15. Specifically, in the table of FIG. 15, a heater lighting duty is 0% in each of columns identified by a value greater than −3° C. and that less than 0° C. in the index of "currently detected temperature-target temperature" and a value greater than 0° C. in the index of "currently detected temperature-lastly detected temperature". More specifically, when a currently detected temperature is greater than a previously detected temperature (i.e., temperature rising tendency is present) and lower than the target temperature, the heater is controlled not to generate heat in this embodiment.

Here, in the example of FIG. 15, a range identified by a value greater than −3° C. and that less than 0° C. in the index of "currently detected temperature-target temperature" is designated as a temperature range lower than the "target temperature". However, a lower limit of the range can be a value other than the "target temperature −3° C.".

As in the above-described embodiment, control using the table of FIG. 15 is executed during a warm-up stage and when a fixing roller stops rotating at the time and a detected temperature has reached a target temperature. Further, at that moment, when a value in the index of "currently detected temperature-target temperature" is above −3° C. and less than 0° C. and a value in the index of "currently detected temperature-lastly detected temperature" is greater than 0° C., the heater is turned off. Otherwise, the heater is turned on with a lighting duty of about 100%.

By controlling the temperature of the fixing roller in this way in the third embodiment, when a currently detected temperature shows a rising tendency and falls within a range less than the target temperature, the heater is stopped heating at an early stage so that a detected temperature does not reach the target temperature. Hence, a temperature ripple possibly occurring during the warm-up stage can be reduced, while preventing high temperature offset from occurring especially when a fixing roller having a bad thermal response is used and a printing stage is entered.

Figure 16:
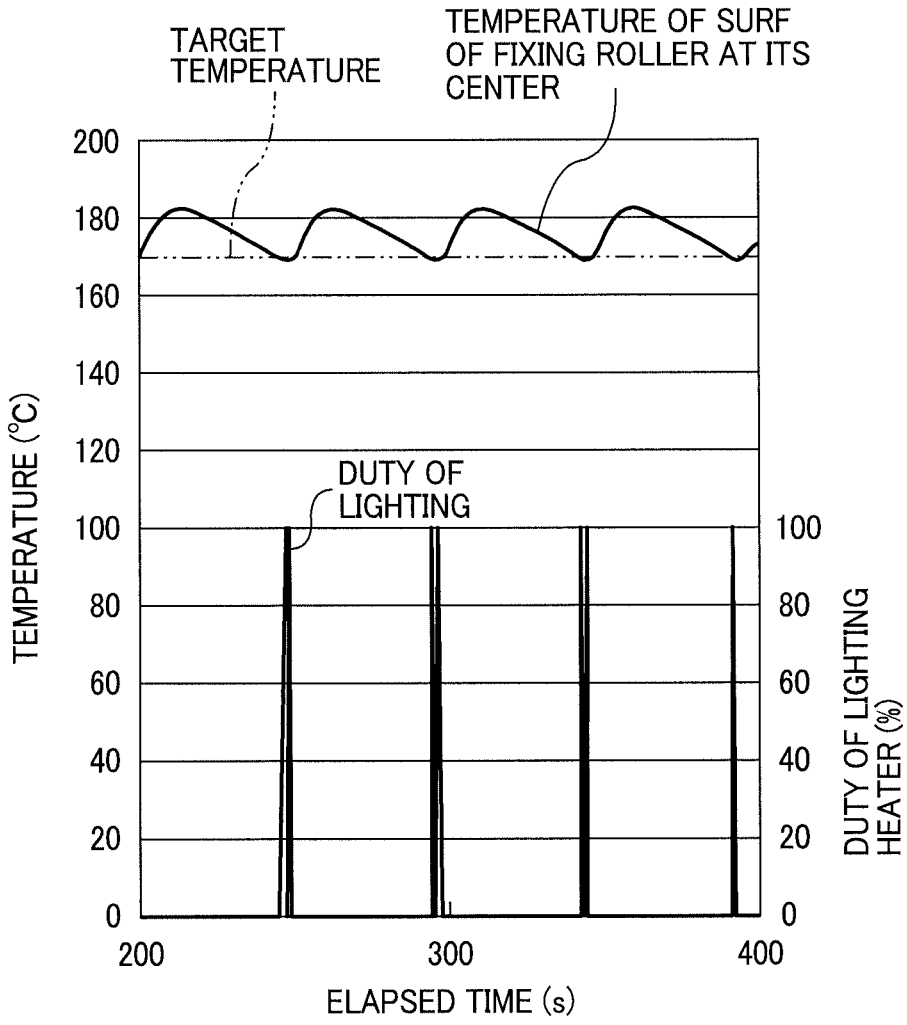
FIG. 16 is a diagram illustrating a temperature wave actually appearing in a fixing roller when the temperature control method of the above-described third embodiment is implemented.

FIG. 16 is a diagram that shows an actual temperature waveform of the fixing roller when the temperature control is executed using the method of the third embodiment. In the example of FIG. 16, temperature fluctuation of the fixing roller is minimized in a range between 170° C. and 180° C., and the temperature ripple can also be reduced more efficiently than the example of FIG. 14.

In the above-described various embodiments, although heating control for the heater during the warm-up stage is executed based on both rotation of the fixing roller and arrival of the detected temperature at the target temperature, alternatively it can be based on only one of them. Further, the image forming apparatus with the fixing device according to one embodiment of the present invention is not limited to the color laser printer shown in FIG. 1, and alternatively can employ various other systems, such as a monochrome printer, another type of a printer, a copier, a facsimile, and a multifunctional machine, etc.

As described heretofore, according to one embodiment of the present invention, by controlling the heater during the warm-up stage based on one of the rotation of the fixing roller and arrival of the detected temperature at the target temperature after the warm-up stage is entered, an overshoot and a high-temperature offset can be minimized. Hence, quality of a fixing image can be improved, and accordingly a reliable fixing device and an image forming apparatus with it can be provided.

Numerous additional modifications and variations of the present invention are possible in light of the above teachings. It is therefore to be understood that within the scope of the appended claims, the present invention may be practiced otherwise than as specifically described herein.

What is claimed is:

1. A fixing device operable through start-up and warm-up stages, the fixing device comprising:

a rotatable fixing member to fix an unfixed toner image borne on a recording medium;

an opposing member to press against the fixing member and form a nip on the rotatable fixing member, the nip allowing the recording medium to pass through the nip bearing the unfixed toner image thereon;

a temperature detector to detect temperature of the fixing member; and a heater generally controlled in accordance with the temperature detected by the temperature detector to heat the fixing member, wherein the heater is further controlled during the warm-up stage in accordance with at least one of if the fixing member is rotating in the warm-up stage and if the temperature detected by the temperature detector has ever arrived at a prescribed target temperature in the warm-up stage.

2. The fixing device as claimed in claim 1, wherein the heater is activated with a lighting duty of less than 100% or a lighting duty of about 100% at a prescribed time interval when the fixing member is rotating and the detected temperature is lower than the prescribed target temperature in the warm-up stage.

3. The fixing device as claimed in claim 2, wherein the heater is activated with a lighting duty of less than 100% in accordance with a difference between a detected temperature and the target temperature.

4. The fixing device as claimed in claim 1, wherein the heater is activated with a lighting duty of less than 100% or a lighting duty of about 100% at a prescribed time interval until the detected temperature reaches the prescribed target temperature when the fixing member is not rotating and the detected temperature has never reached the prescribed target temperature in the warm-up stage after the warm-up stage starts.

5. The fixing device as claimed in claim 4, wherein the heater is activated substantially continuously when the fixing member is not rotating and a detected temperature has reached the prescribed target temperature even once after the warm-up stage starts and a currently detected temperature is lower than the target temperature in the warm-up stage.

6. The fixing device as claimed in claim 5, wherein the heater is deactivated when the fixing member is not rotating and the detected temperature has reached the prescribed target temperature even once after the warm-up stage starts, and a currently detected temperature is higher than a previously detected temperature and lower than the target temperature in the warm-up stage.

7. An image forming apparatus including a fixing device operable through start-up and warm-up stages, the fixing device comprising:

a rotatable fixing member to fix an unfixed toner image borne on a recording medium;

an opposing member to press against the fixing member and form a nip on the rotatable fixing member, the nip allowing the recording medium to pass through bearing the unfixed toner image thereon;

a temperature detector to detect temperature of the fixing member;

a heater generally controlled in accordance with the temperature detected by the temperature detector to heat the fixing member, wherein the heater is further controlled during the warm-up stage in accordance with at least one of if the fixing member is rotating in the warm-up stage and if the temperature detected by the temperature detector has ever arrived at a prescribed target temperature in the warm-up stage.

8. The image forming apparatus as claimed in claim 7, wherein the heater is activated with a lighting duty of less than 100% at no time-interval or a lighting duty of about 100% at a prescribed time interval when the fixing member is rotating and a detected temperature is lower than the prescribed target temperature in the warm-up stage.

9. The image forming apparatus as claimed in claim 8, wherein the heater is activated with a lighting duty of less than 100% in accordance with a difference between a detected temperature and the target temperature.

10. The image forming apparatus as claimed in claim 7, wherein the heater is activated with a lighting duty of less than 100% at no time-interval or a lighting duty of about 100% at a prescribed time interval until a detected temperature reaches the prescribed target temperature when the fixing member is not rotating and the detected temperature has never reached the prescribed target temperature in the warm-up stage after the warm-up stage starts.

11. The image forming apparatus as claimed in claim 10, wherein the heater is activated substantially continuously when the fixing member is not rotating and a detected temperature has reached the prescribed target temperature even once after the warm-up stage starts and a currently detected temperature is lower than the target temperature in the warm-up stage.

12. The image forming apparatus as claimed in claim 11, wherein the heater is deactivated when the fixing member is not rotating and the detected temperature has reached the prescribed target temperature even once after the warm-up stage starts, and a currently detected temperature is higher than a previously detected temperature and lower than the target temperature in the warm-up stage.

13. A method of fixing an unfixed toner image onto a recording medium after start-up and warm-up stages, the method comprising the steps of:

forming a fixing nip on a rotatable fixing member by pressing an opposing member against the fixing member;

conveying a recording medium through the fixing nip bearing the unfixed toner image on the recording medium;

detecting temperature of the fixing member;

heating the fixing member with a heater in accordance with the temperature of the fixing member; and controlling temperature of the heater in the warm-up stage in accordance with at least one of if the fixing member is rotating in the warm-up stage and if the temperature has ever arrived at a prescribed target temperature in the warm-up stage.

14. The method as claimed in claim 13, further comprising the step of:

determining if the fixing member is rotating in the warm-up stage, wherein the heater is activated with a lighting duty of less than 100% or a lighting duty of about 100% at a prescribed time interval when the fixing member is rotating and a detected temperature is lower than the prescribed target temperature in the warm-up stage.

15. The method as claimed in claim 14, wherein the heater is activated with a lighting duty of less than 100% in accordance with a difference between a detected temperature and the target temperature.

16. The method as claimed in claim 13, further comprising the step of:

determining if the fixing member is rotating in the warm-up stage, wherein the heater is activated with a lighting duty of less than 100% or a lighting duty of about 100% at a prescribed time interval until a detected temperature reaches the prescribed target temperature when the fixing member is not rotating and the detected temperature has never reached the prescribed target temperature in the warm-up stage after the warm-up stage starts.

17. The method as claimed in claim 13, further comprising the steps of:

determining if the fixing member is rotating in the warm-up stage; and determining if a detected temperature has reached the prescribed target temperature even once after the warm-up stage starts, wherein the heater is activated substantially continuously when the fixing member is not rotating and a detected temperature has reached the prescribed target temperature even once after the warm-up stage starts and a currently detected temperature is lower than the target temperature in the warm-up stage.

18. The method as claimed in claim 13, further comprising the steps of:

determining if the fixing member is rotating in the warm-up stage; and determining if a detected temperature has reached the prescribed target temperature even once after the warm-up stage starts, wherein the heater is controlled during the warm-up stage in accordance with one of if the fixing member is rotating in the warm-up stage and if the temperature detected by the temperature detector has ever arrived at a prescribed target temperature in the warm-up stage.

* * * * *